US008794866B2

(12) United States Patent
Petryshyn

(10) Patent No.: US 8,794,866 B2
(45) Date of Patent: Aug. 5, 2014

(54) COLLAPSIBLE BARRICADE APPARATUS

(76) Inventor: Taras Petryshyn, Franklin Park, IL (US)

( * ) Notice: Subject to any disclaimer, the term of this patent is extended or adjusted under 35 U.S.C. 154(b) by 0 days.

(21) Appl. No.: 13/506,529

(22) Filed: Apr. 25, 2012

(65) Prior Publication Data

US 2013/0287491 A1 Oct. 31, 2013

(51) Int. Cl.
*E01F 13/00* (2006.01)
*E01F 9/00* (2006.01)

(52) U.S. Cl.
USPC ..... 404/6; 404/10; 49/49

(58) Field of Classification Search
CPC ..... E01F 13/12; E01F 13/06; E01F 13/08; E01F 15/00; E01F 9/0175; E01F 9/019; G09F 15/0062; G09F 15/00
USPC ..... 404/6, 9, 10; 49/49, 9, 381, 131; 116/63 C, 63 P, 63 R; 40/607.02, 607.06, 40/607.07, 607.1, 608
See application file for complete search history.

(56) References Cited

U.S. PATENT DOCUMENTS 1,028,566 A * 6/1912 Gardner ..... 49/131
2,164,985 A * 7/1939 Cardarelli ..... 40/610
2,482,341 A * 9/1949 Holmsten ..... 292/148
2,737,740 A * 3/1956 Genoe ..... 49/381
3,490,749 A * 1/1970 Anderson ..... 256/64
3,671,015 A * 6/1972 Sullivan ..... 254/332
3,688,439 A 9/1972 Doxsee
3,750,331 A * 8/1973 Renaux ..... 49/35
3,757,916 A 9/1973 Selby
3,849,936 A 11/1974 Geraci
3,868,630 A * 2/1975 Lesondak ..... 340/908.1
3,925,929 A 12/1975 Montgomery
4,062,149 A 12/1977 Collins
4,531,472 A 7/1985 Marrero et al.
4,713,910 A 12/1987 Quante
4,822,206 A * 4/1989 Roussel et al. ..... 404/6
4,858,382 A * 8/1989 Ellgass ..... 49/35
4,934,097 A 6/1990 Quante
4,941,284 A 7/1990 Stoller
5,146,710 A 9/1992 Caldweel
5,167,093 A 12/1992 Hamilton
5,228,237 A * 7/1993 Nasatka ..... 49/49
5,452,964 A 9/1995 Trougouboff (Continued)

FOREIGN PATENT DOCUMENTS

WO WO 9002846 A1 * 3/1990 ..... E01F 13/00

*Primary Examiner* — Abigail A Risic
(74) *Attorney, Agent, or Firm* — Meroni & Meroni, P.C.; Charles F. Meroni, Jr.; Christopher J. Scott

(57) ABSTRACT

A collapsible barricade apparatus enables users to selectively barricade space for preventing vehicular traffic to pass therethrough. The barricade apparatus comprises an A-shaped member, a support assembly, and a series of anchor assemblies. The A-shaped member comprises laterally opposed upright sections and inwardly extending, coaxial A-crossbar portions. The A-crossbar portions each comprise an inward terminus. The support assembly comprises two T-shaped sections, one upper and one lower. The T-shaped sections each comprise a shaft end and a T-crossbar end. The shaft ends of the upper and lower section being telescopically cooperable with one another. The T-crossbar end of the upper section is cooperable with the inward termini for coaxially aligning and rotatably connecting the upper section to the inwardly extending A-crossbar portions. The anchor assemblies rotatably anchor the feet of the A-shaped member and the lower section of the support assembly to a primary support surface.

20 Claims, 9 Drawing Sheets

(56) References Cited

U.S. PATENT DOCUMENTS

| | | | | |
|---|---|---|---|---|
| 5,639,178 | A | 6/1997 | Wilson et al. | |
| 5,711,110 | A | 1/1998 | Williams | |
| 6,150,958 | A | 11/2000 | Worsham | |
| 6,308,996 | B1 * | 10/2001 | Ganimian | 292/259 R |
| 7,001,099 | B2 | 2/2006 | Rittenhouse et al. | |
| RE39,170 | E | 7/2006 | Wagner et al. | |
| 7,258,461 | B1 | 8/2007 | Izardel | |
| 7,320,557 | B1 | 1/2008 | Potter | |
| 2002/0043025 | A1 | 4/2002 | Zayas | |
| 2004/0175321 | A1 | 9/2004 | De Souza et al. | |
| 2012/0177439 | A1 * | 7/2012 | More et al. | 404/6 |

* cited by examiner

FIG. 9
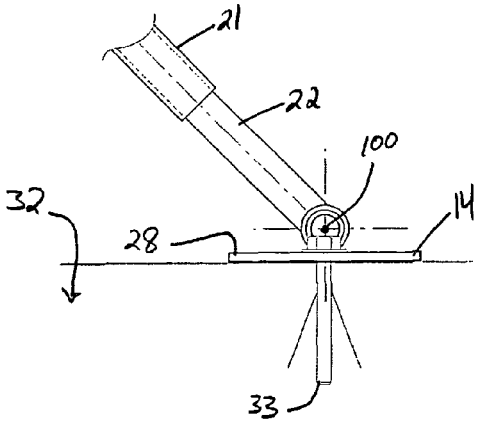
FIG. 10
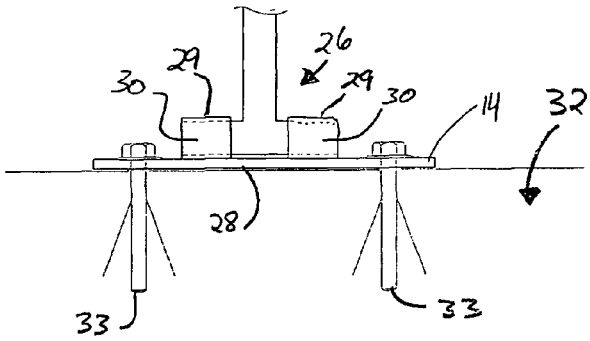
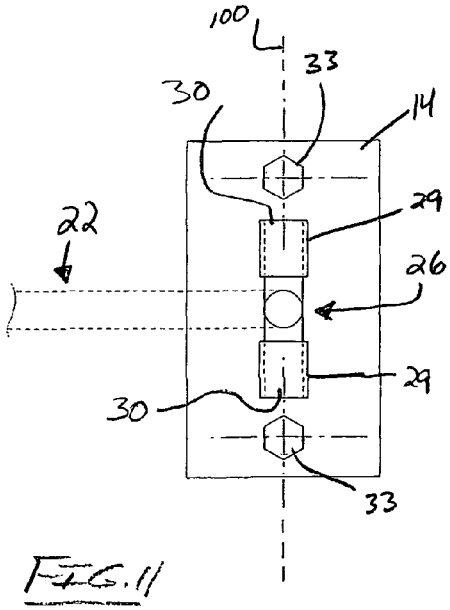
FIG. 11
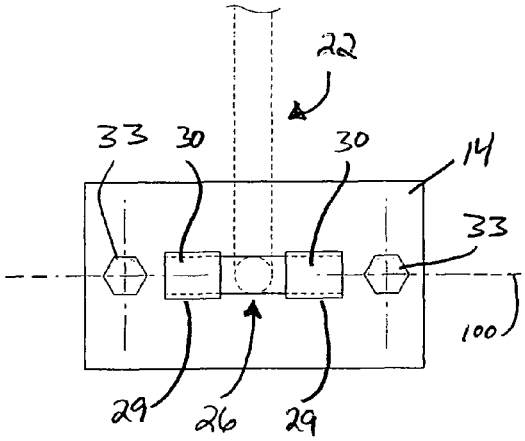
FIG. 12

COLLAPSIBLE BARRICADE APPARATUS

BACKGROUND OF THE INVENTION

1. Field of the Invention

The present invention generally relates to an apparatus for barricading a certain space. More particularly, the present invention relates to a collapsible barricade apparatus for enabling a user to selectively barricade a vehicular thoroughfare for preventing unwanted vehicular traffic to pass through the space occupied by the barricade apparatus when in an upright, space-barricading configuration.

2. Description of Prior Art

U.S. Pat. No. 3,688,439 ('439 patent), which issued to Doxsee, discloses a Barrier for Parking Spaces. The '439 patent describes a barrier which can be raised and lowered to permit only authorized parking within a given parking space. The barrier is pivotally mounted on a base plate which is fixed in the ground, and the barrier is in the form of a post having an internal locking member and a lift mechanism which is reinforced by the post against bending or other distortion. A lift handle is located transversely within the post and extends on either side for a sufficient distance so that conventional size automobiles cannot fit between adjacent barriers. A security device prevents lifting of the locking means except by operation of a key issued to the authorized user.

U.S. Pat. No. 3,925,929 ('929 patent), which issued to Montgomery, discloses a Parking Space Barrier. The '929 patent describes a temporary barrier to selectively block a traffic lane, a driveway or the access to an enclosed parking space which comprises a vertical post inserted into a ground imbedded receptacle. Within the post a flexible locking lever can be released through a pinhole which may be obstructed by means of a padlock thus preventing the removal of the post.

U.S. Pat. No. 4,062,149 ('149 patent), which issued to Collins, discloses a Parking Space Barrier. The '149 patent describes a temporary barrier to selectively block a traffic lane, a driveway or the access to an enclosed parking space which comprises a vertical post inserted into a ground imbedded receptacle. Within the post a flexible locking lever can be released through a pinhole which may be obstructed by means of a padlock thus preventing the removal of the post.

U.S. Pat. No. 4,858,382 ('382 patent), which issued to Ellgass, discloses an Articulatable Barrier for Restricting Access to Parking Spaces, Roadways, Passageways and the Like. The '382 patent describes an articulatable barrier for selectively restricting access to a parking space, roadway, passageway comprising a base and a barrier frame that is pivotally journaled through the base at a pivot axis for pivotal movement of the frame between a first obstructing position and a second non-obstructing position. The base has an aperture formed therein above the pivot axis.

The frame carries a center bolt for movement of the bolt between a first lowered position and a second raised position. In the first lowered position, the bolt is received in the base through the aperture, for supporting the frame and for maintaining the frame in the obstructing position. In the second raised position, the bolt is spaced from the aperture and the base for permitting the pivotal movement of the frame. Means are provided for moving the bolt in a second raising direction, wherein the bolt is withdrawn from the base and the aperture being moved into the second raised position. This means also permits the bolt to move in a first lowering position, wherein, when the frame is in the obstructing position, the bolt is received in the base through the aperture.

U.S. Pat. No. 5,167,093 ('093 patent) which issued to Hamilton, discloses a Parking Barrier. The '093 patent describes a parking barrier apparatus for restricting ingress into and egress from a parking space is disclosed. The parking barrier includes an elongate, substantially planar base member adapted to be secured onto the ground of a parking space. An elongate carrying cover of is pivotally connected to the base member and movable from a first, upright position into a second, prone position.

The carrying cover includes a substantially U-configured channel portion that is inverted and covers a portion of the base member when the carrying cover is upright. A barrier member is secured to the elongate cover and extends outward therefrom. A lock mechanism is secured within the channel of the carrying cover for engaging and locking the cover in the first, raised position. The lock mechanism remains substantially enclosed by the carrying cover and base member when the carrying cover is upright to prevent tampering with the lock mechanism.

U.S. Pat. No. 5,711,110 ('110 patent), which issued to Williams, discloses a Vehicle Parking Barrier. The '110 patent discloses a parking barrier permanently installed in vehicle parking surface, which has a base, with legs embedded within the surface. A hinge plate is attached to the base and allows the barrier to be rotated to a horizontal position permitting a vehicle to safely pass over the collapsed barrier. A channel shaped post is pivotally attached to the hinge plate and a rigid strut is retained on one end within the post and, on the other, to the hinge plate. The strut forms a right angle triangle with the post.

A pull pin holds the upper end of the strut in place. When the pull pin is removed, the pull pin removal permits the barrier to be rotated horizontally removing the obstruction. A second, or electromechanical, embodiment utilizes a linear actuator for the strut. An electronic controller receives a signal through a coded radio frequency transmitter and receiver and, in turn, energizes the actuator to rotate the barrier into a horizontal position. Limit switches and control positioning and indicator lights and denote the barriers position. The electrical system operates on low voltage direct current supplied by a D.C. power supply.

U.S. Pat. No. 6,150,958 ('958 patent), which issued to Worsham, discloses a Remote Controlled Parking Barrier Apparatus. The '958 patent describes a radio-operated parking barrier apparatus is provided that includes a base housing, a barrier arm including a shaft rotatably mounted in the housing, and a drive assembly disposed within the base housing that includes a pivot arm having a proximal end affixed to the shaft, and a driver having a reciprocally driven plunger movably connected to a distal end of the pivot arm.

The back end of the driver is pivotally connected to the floor panel of the base housing to accommodate the vertical movement of the accurate motion that the end of the plunger must necessarily follow in converting the linear movement of the plunger into the rotation movement of the barrier arm around the shaft mounted in the base housing. The driver preferably utilizes a threaded shaft and drive nut to reciprocate the driver in operating the device. The drive assembly provides a simple and reliable linkage between the barrier arm and the base housing.

United States Patent Application No. 2002/0043025, which was authored by Zayas, describes a pivoting channel like post attached with rivets to a base bolted to the pavement, shaped both from stamped and bent metal sheets with some welding. A rigid metal strut stand has riveted axles on both ends that slide on rails cut into the post and the base. A locking device inside the post also shaped from stamped and bent metal is attached with rivets that slide on rails cut in the post. A pedal like component and a handle are riveted or welded to the post. Pressure fasteners will fit into holes in the post to hold sign. Bent metal strips extending from the post attached with screws will hold sign.

Staples welded to post and locking device will hold a padlock. Springs are attached to pins or barbs cut from the metal. A second alternative embodiment has a commercially available lock installed in the post. A sliding locking device will engage the lock. The locking device shape fits the type of lock used. A third alternative embodiment has the rigid metal strut stand base end sliding on a rotating threaded shaft connected to a D/C powered motor. The motor is turned on by a radio-wave remote control, will shut down if there's resistance to movement, a sensor will also shut down the motor if there's a vehicle over the barrier. A fourth alternative embodiment is A/C powered instead.

It will be seen from an inspection of the prior art that the prior art perceives a need for a low cost, readily collapsible barricade apparatus for enabling users thereof to outfit designated spaces for preventing vehicular access to the spaces whereby the device or apparatus comprises a vertical upright and a telescopic support assembly angled relative to the vertical upright, and which upright and support assembly are anchored to a single, uniform plane.

SUMMARY OF THE INVENTION

To achieve these and other readily apparent objectives, the present invention essentially provides a collapsible barricade apparatus that essentially functions to enable users to selectively barricade certain space for preventing vehicular traffic to pass therethrough. The collapsible barricade apparatus essentially comprises an A-shaped upright member or A-frame member, a telescopic support assembly, and certain anchoring means as preferably exemplified by a series of anchor assemblies.

The A-shaped upright member preferably comprises laterally opposed upright sections and laterally opposed, coaxially aligned, inwardly extending A-crossbar portions. Each upright section preferably comprises a T-shaped footing section. The T-shaped footing sections preferably comprise a central shaft portion and a T-crossbar or footing crossbar portion orthogonally extending relative to the central shaft portion. The A-crossbar portions each preferably comprise an inward terminus.

The telescopic support assembly preferably comprises a T-shaped upper section and a T-shaped lower section. The T-shaped upper section and the T-shaped lower section each comprise a shaft-engaging end and a T-crossbar end. The T-crossbar ends are orthogonal to the shaft ends in a manner that is akin to the structural arrangement of the T-crossbar or footing crossbar portions relative to the central shaft portions. The shaft ends of the upper and lower sections are telescopically cooperable with one another.

The T-crossbar end of the upper section is further cooperable with the inward termini for coaxially aligning and rotatably connecting the upper section to the inwardly extending A-crossbar portions. In other words, the coaxially aligned termini of the T-crossbar end of the upper section cooperate with the termini for coaxially aligning and rotatably connecting the upper section to the A-crossbar portions.

The upper section and the lower section of the telescopic support assembly preferably comprise certain cooperable lock-receiving means for receiving a lock when the barricade apparatus is in an upright, space-barricading configuration. The lock functions to prevent the shaft ends of the support assembly from telescopically extending relative to one another for collapsing the barricade apparatus to a collapsed, space-opening configuration.

The preferred lock-receiving or lock-engaging means of the support assembly may preferably be defined by first and second ring structures. The first ring structure is preferably attached to the upper section, and the second ring structure is preferably attached to the lower section such that the ring structures are coaxially aligned and adjacent to one another when the barricade apparatus is in an upright, space-barricading configuration for receiving the lock.

When the lock is removed, the barricade apparatus may be positioned in a collapsed, space-opening configuration by telescopically extending the shaft ends relative to one another. The ring structures of the support assembly are distanced from one another when in the collapsed, space-opening configuration. The first and second ring structures preferably extend orthogonally relative to the shaft ends of the upper and lower sections and are in axial alignment parallel to the shaft ends of the support assembly.

The series of anchor assemblies exemplify the preferred anchoring means contemplated by the present invention. First, second, and third anchor assemblies preferably define the number of anchor assemblies. The anchor assemblies each preferably comprise a planar portion, and laterally opposed crossbar-engaging portions. The first and second anchor assemblies function to rotatably receive and anchor the T-crossbar portions of the upright sections, and the third anchor assembly functions to rotatably receive and anchor the T-crossbar end of the lower section. The planar portions interface the T-crossbar portions 19 and the T-crossbar end 26 with a primary support surface.

BRIEF DESCRIPTION OF THE DRAWINGS

Other features of my invention will become more evident from a consideration of the following brief description of patent drawings:

FIG. 9 is a fragmentary left lateral diagrammatic type view of the lower section of the support assembly anchored to an underlying support structure via an anchor assembly according to the present invention.

FIG. 10 is a fragmentary rear diagrammatic type view of the lower section of the support assembly anchored to an underlying support structure via an anchor assembly according to the present invention.

FIG. 11 is a first fragmentary top plan, diagrammatic type view of the lower section of the support assembly anchored to an underlying support structure via an anchor assembly according to the present invention.

FIG. 12 is a secondary fragmentary top plan, diagrammatic type view of the lower section of the support assembly anchored to an underlying support structure via an anchor assembly according to the present invention.

DETAILED DESCRIPTION OF THE PREFERRED EMBODIMENT

Figure 1:
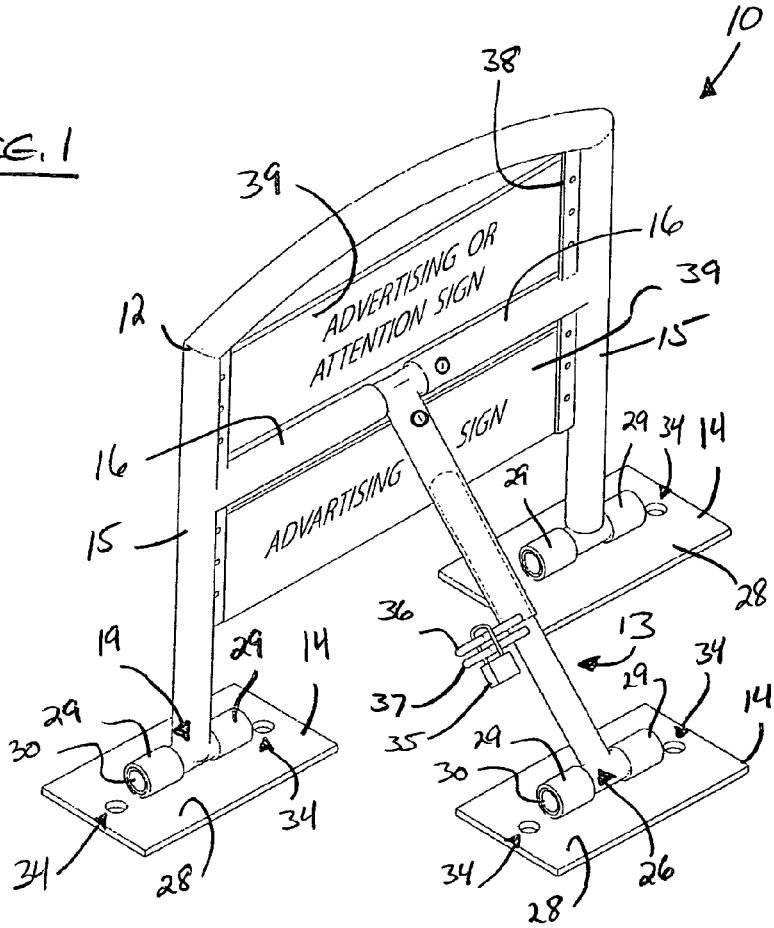
FIG. 1 is a top perspective view of the collapsible barricade apparatus according to the present invention depicting the apparatus in an upright, space-barricading configuration, and showing the relative positions of a vertical or upright A-frame member (outfitted with optional signage), a support assembly angled relative to the vertical upright A-frame member, and a series of anchor assemblies for anchoring the feet of the upright A-frame member and support assembly to a support surface.

Referring now the drawings with more specificity, the present invention essentially provides a collapsible barricade apparatus as illustrated and referenced at 10. The collapsible barricade apparatus 10 essentially functions to enable users to selectively barricade certain space for preventing vehicular traffic (as at 11) to pass through space occupied by the barricade apparatus 10 when in an upright, space-occupying configuration as generally depicted in FIGS. 1 and 3-7.

The barricade apparatus 10 according to the present invention essentially comprises an A-shaped upright member or A-frame construction as at 12, a telescopic support assembly 13 rotatably connected to the A-frame construction 12, and certain anchoring means for anchoring the A-frame construction and support assembly 13 to a primary support surface. The anchoring means may be preferably exemplified by a series of anchor assemblies as illustrated and referenced at 14.

The A-shaped upright member or construction 12 preferably comprises a top crossbar portion 50 laterally opposed upright sections 15, and laterally opposed, coaxially aligned, inwardly extending, hollow A-crossbar portions 16. The A-shaped upright member or construction 12 further preferably comprises laterally opposed, inwardly extending upper and lower flange structures as at 38.

The upper flange structures 38 materially join the laterally opposed, upright sections 15 to both the top crossbar portion 50 and the laterally opposed, coaxially aligned, inwardly extending hollow cylindrical A-crossbar portions 16 at upper junction sites 51. The upper flange structures 38 thereby form a flange-reinforced upper A section as at 52.

Further, the lower flange structures 38 materially join the laterally opposed upright sections 15 to the laterally opposed, coaxially aligned, inwardly extending hollow cylindrical A-crossbar portions 16 at upper junction sites 53 thereby forming a flange-reinforced lower A section as at 54. The upper and lower flange structures 38 thus basically function to reinforce and maintain the shape of the A-shaped member or construction 12.

Each upright section 15 preferably comprises a T-shaped footing section as at 17. The T-shaped footing sections 17 preferably comprise a central shaft portion as at 18 and a T-crossbar or footing crossbar portion 19 orthogonally extending relative to the central shaft portion 18. The A-crossbar portions 16 each preferably comprise an inward terminus as at 20. The inward termini 20 have been illustrated as comprising exemplary female structure.

The A-shaped upright member or A-frame construction 12 may preferably further comprise laterally opposed, inwardly extending flange structures 38, which structures 38 extend inwardly from the upright sections 15. It is contemplated that the laterally opposed, inwardly extending flange structures 38 may well function to enable a user to attach optional signage 39 adjacent the A-crossbar portions 16. Together, the flange structures 38 and optional signage as at 39 may enhance visibility of the barricade apparatus 10 when the barricade apparatus 10 is in the upright, space-barricading configuration generally depicted in FIGS. 1 and 3-7.

The telescopic support assembly 13 preferably comprises a T-shaped upper section 21 and a T-shaped lower section 22. The T-shaped upper section 21 and the T-shaped lower section 22 each comprise a shaft-engaging end and a T-crossbar end. The T-crossbar ends are orthogonal to the shaft ends in a manner that is akin to how the T-crossbar or footing crossbar portions 19 are orthogonal to the central shaft portions 18. The shaft ends of the upper and lower sections 21 and 22 are telescopically cooperable with one another (for example, the shaft end of the lower section 22 is receivable in the female structure of the shaft end of upper section 21 as illustrated).

The T-crossbar end of the upper section 21 is further cooperable with the inward termini 20 for coaxially aligning and rotatably connecting the upper section 21 to the inwardly extending A-crossbar portions 16. In other words, the coaxially aligned exemplary male termini 23 of the T-crossbar end of the upper section 21 extend into the exemplary female structure of the termini 20 for coaxially aligning and rotatably connecting the upper section 21 to the A-crossbar portions 16. The T-crossbar end of upper section 21 is referenced at 24 and the shaft end of upper section 21 is referenced at 25. The T-crossbar end of lower section 22 is referenced at 26, and the shaft end of lower section 22 is referenced at 27. Male shaft end 27 is shown/illustrated as being receivable by certain exemplary female structure of shaft end 25.

The upper section 21 and the lower section 22 of the telescopic support assembly 13 further preferably comprise certain cooperable lock-receiving means for receiving a (pad) lock (as generically depicted at 35) when the barricade apparatus 10 is in an upright, space-barricading configuration as generally depicted in FIGS. 1 and 3-7.

Figure 2:
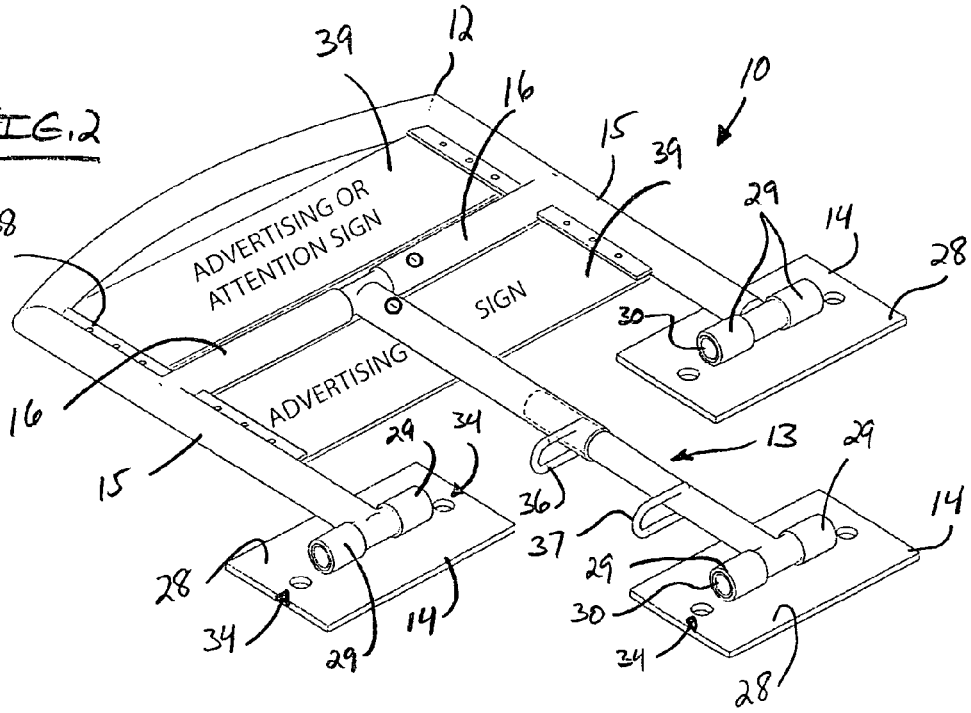
FIG. 2 is a top perspective view of the collapsible barricade apparatus according to the present invention depicting the apparatus in a collapsed, space-opening configuration, and showing the relative positions of the horizontal A-frame member (outfitted with optional signage), the support assembly made coplanar with the A-frame member, and a series of anchor assemblies for anchoring the feet of the A-frame member and support assembly to a support surface parallel to the collapsed A-frame member and support assembly.

The lock 35 functions to prevent the shaft ends 25 and 27 from telescopically extending or displacing elative to one another. When the lock or similar other structure is removed, and the shaft ends are telescopically for collapsing the barricade apparatus 10 to a collapsed, space-opening configuration as generally depicted in FIG. 2 (and FIG. 7 in broken lines). The telescopic support assembly 13 and/or one or more of the A-crossbar portions 16 may be optionally outfitted with cabinet type locks as at 40. When the apparatus 10 outfitted with cabinet type locks 40, the (pad)lock 35 may provide optionally enhanced locking securement for the apparatus as heretofore described.

Figure 7:
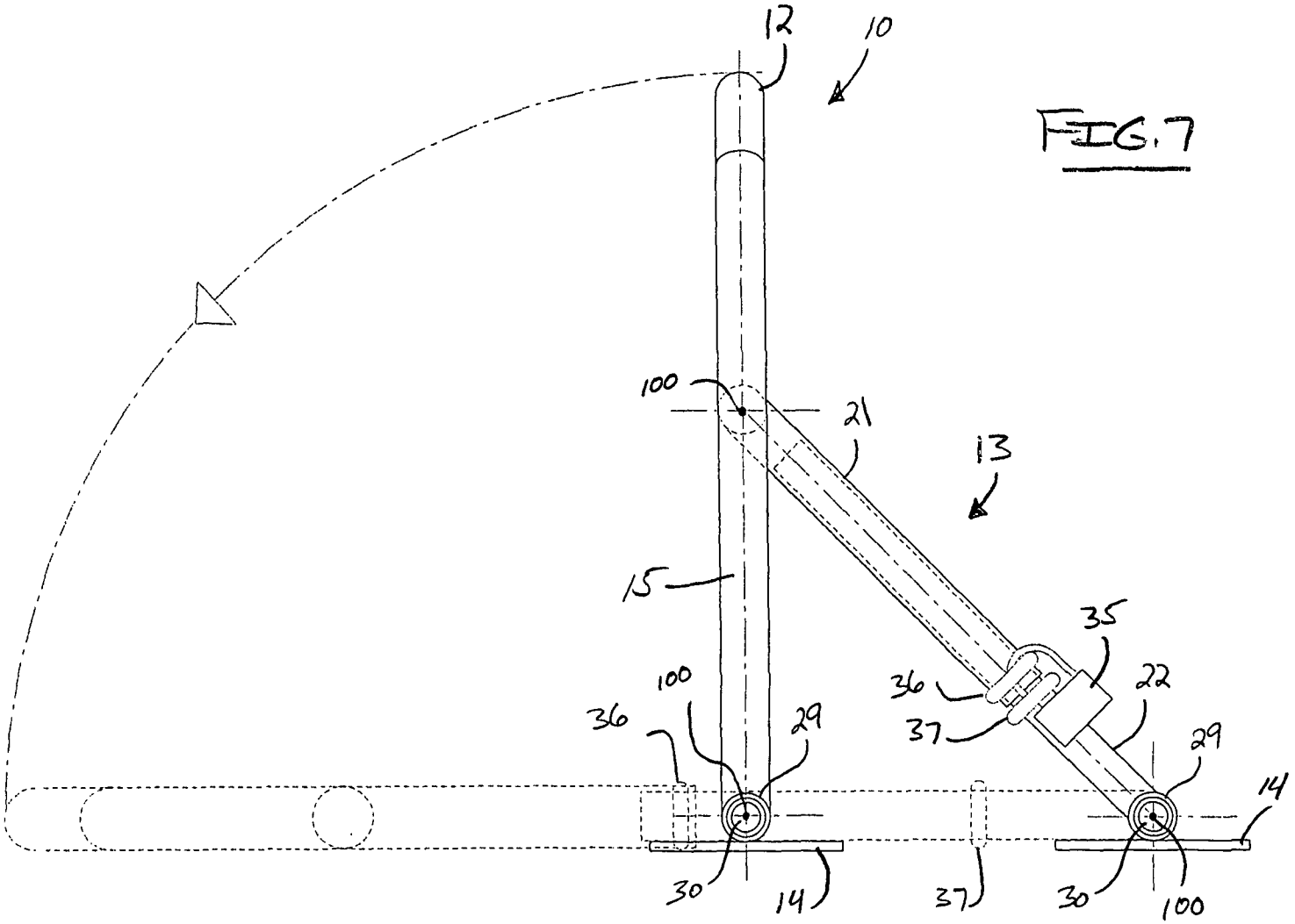
FIG. 7 is a left lateral elevational view of the collapsible barricade apparatus according to the present invention depicting (in solid lining) the barricade apparatus in an upright, space-barricading configuration, and (in broken lining) the barricade apparatus in a collapsed, space-opening configuration.
Figure 8:
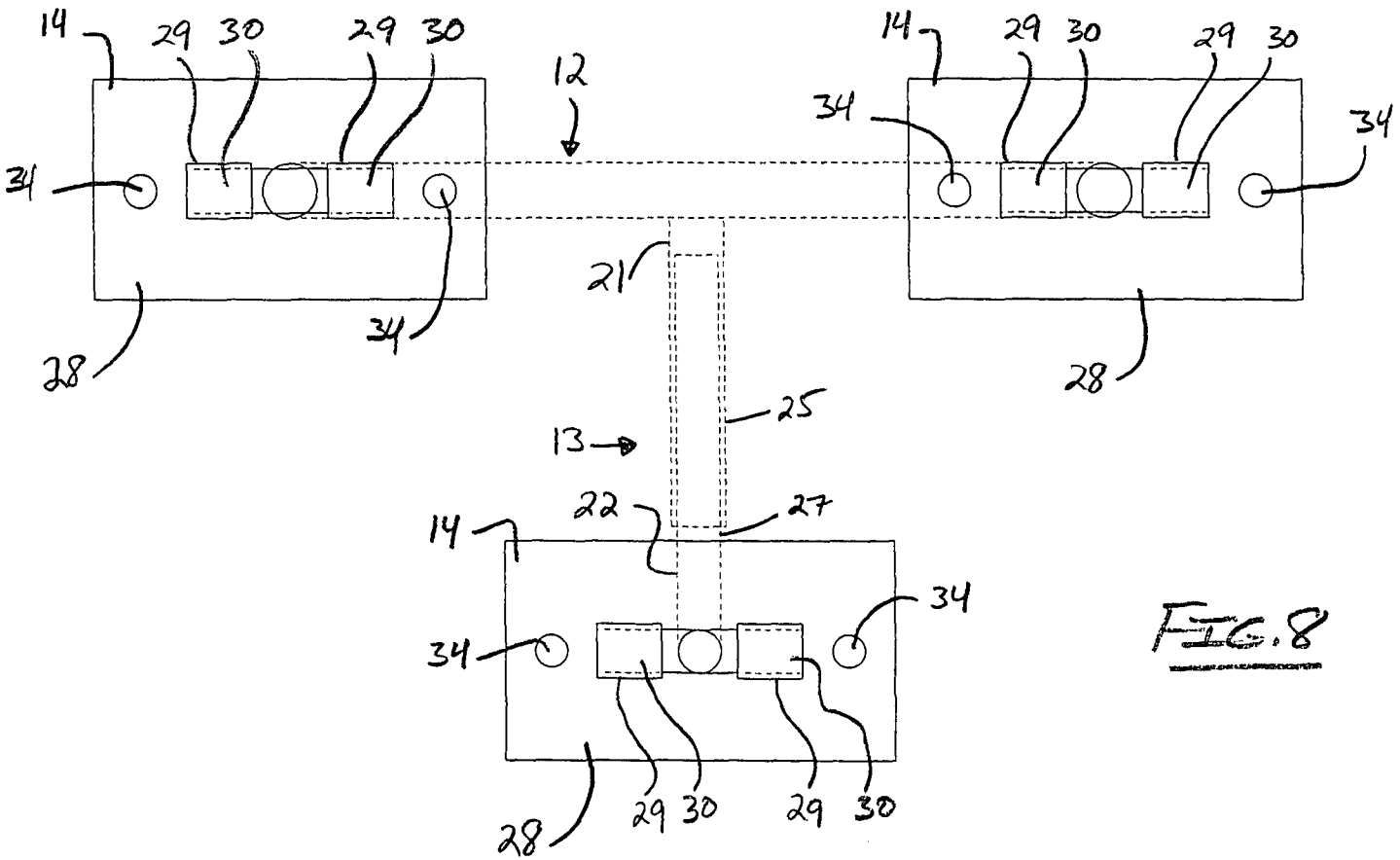
FIG. 8 is a top plan view of three anchor assemblies according to the present invention shown in the relative positioned placement for anchoring the A-frame member and support assembly (depicted in broken lines) to a support surface.

The telescopic support assembly 13 preferably extends in a plane angled 45 rotational degrees relative to the vertically oriented upright member 16 when the barricade apparatus 10 is in an upright, space-barricading configuration as generally depicted in FIGS. 1 and 3-7. As the barricade apparatus is collapsed into a flat position parallel to the support structure (as at 31 or 32), the shaft ends 25 and 27 are telescopically displaced away from one another or elongated and rotate to a coplanar position with the upright member 16 as depicted in FIGS. 2 and 7 (broken lines).

Axes of rotation 100 extend through the T-crossbar ends 24 and 26 as well as crossbar portions 19. From a comparative inspection of FIGS. 1 and 2, as well as from an inspection of FIG. 7, it will be seen that when the apparatus 10 is unlocked at the site of the lock-receiving means, the shaft ends 25 and 27 may be displaced away from one another such that the (I-shaped) telescopic support assembly 13 elongates along the center telescopic shaft while simultaneously rotates about the axes 100 so as to collapse the apparatus into the collapsed, space-opening configuration shown or depicted in FIGS. 2 and 7 (broken lines).

The preferred lock-receiving or lock-engaging means of the support assembly 13 may preferably be defined by first and second ring structures as at 36 and 37 respectively. the first ring structure 36 is preferably attached (e.g. welded) to the upper section 21, and the second ring structure 37 is preferably attached (e.g. welded) to the lower section 22 such that the ring structures 36 and 37 are coaxially aligned and adjacent to one another when the barricade apparatus 10 is in an upright, space-barricading configuration for receiving the lock 35 or similar other locking mechanism (e.g. certain means for preventing the displacement of rings 36 and 37 away from one another).

When the lock 35 is removed, the barricade apparatus 10 may be positioned in a collapsed, space-opening configuration by telescopically extending the shaft ends 25 and 27 relative to one another. Ring structures 36 and 37 are distanced from one another when in the collapsed, space-opening configuration as generally depicted in FIGS. 2 and 7. The first and second ring structures 36 and 37 preferably extend orthogonally relative to the shaft ends 25 and 27 of the upper and lower sections 21 and 22 and are in axial alignment parallel to the shaft ends 25//27.

The series of anchor assemblies 14 exemplify the preferred anchoring means contemplated by the present invention. First, second, and third anchor assemblies 14 preferably define the number of anchor assemblies. The anchor assemblies 14 each preferably comprise a planar portion as at 28, and laterally opposed crossbar-engaging portions as at 29. The crossbar-engaging portions 29 have been illustrated to show female structure for receiving opposed termini 30 of the portions 19 and end 26.

The first and second anchor assemblies 14 function to rotatably receive and anchor the T-crossbar portions 19 of the upright sections 15, and the third anchor assembly 14 functions to rotatably receive and anchor the T-crossbar end 26 of the lower section 22. The planar portions 28 interface the T-crossbar portions 19 and the T-crossbar end 26 with a primary planar support surface as at 31 (wood sheet) or 32 (concrete or asphalt). The planar portions 28 are preferably fastenable to the primary planar support surface 31 (wood sheet) or 32 (concrete or asphalt) via certain fastening means as may be exemplified by certain bolt or bolt-like hardware as at 33 receivable in the primary planar support surfacing 31 or 32 via apertures 34 formed in the support surface 31 (or 32).

The primary planar support surface referenced at 31 is contemplated to take some form of structural sheet material as may be exemplified by plywood, but not limited thereby. It is contemplated that when the sheet of structural material 31 is fastened to the anchor assemblies 14, the entire ensemble thus enables a user to place the primary (planar) support surface or sheet of material 31 upon a secondary (planar) support surface as may be exemplified by asphalt or concrete (a typical paving surface for vehicular traffic 11). Thus, in a first embodiment, it is contemplated that the collapsible barricade apparatus 10 may be made portable as outfitted upon a portable material sheet 31.

In a second embodiment, the primary planar support surface may be thought of as the upper surface of a fixed anchor material such as asphalt or concrete. In such a scenario, or structural arrangement, the planar portions 28 are fastenable to the fixed anchor material for preventing a user from dislodging the collapsible barricade apparatus 10, and thus the apparatus 10 becomes less portable and more fixed so as to prevent would be users of the barricaded space from moving the otherwise portable apparatus 10.

While the above description contains much specificity, this specificity should not be construed as limitations on the scope of the invention, but rather as an exemplification of the invention. For example, it is contemplated that the present invention essentially provides a collapsible barricade apparatus 10 for selectively barricading space such as a parking space, a driveway, or thoroughfare. The collapsible barricade apparatus comprises a substantially planar upright member such as upright member 12, a telescopic support assembly (for supporting the upright member), and certain anchoring means for anchoring the upright member and the support assembly to a support surface.

Figure 3:
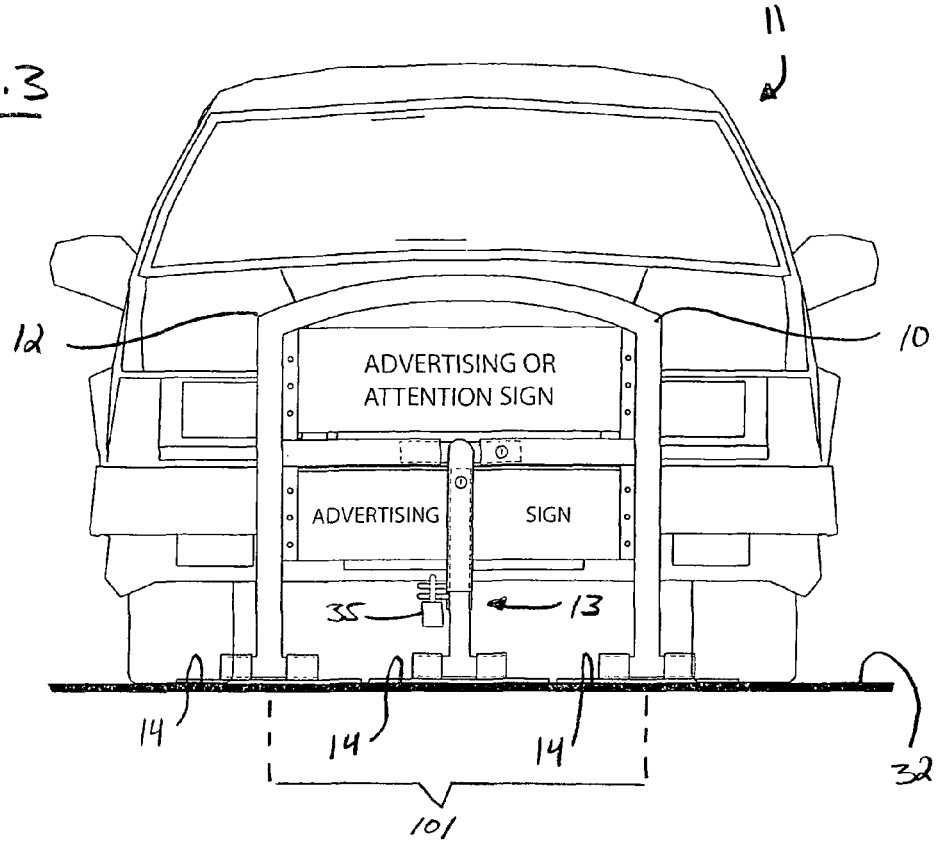
FIG. 3 is a rear elevational view of the collapsible barricade apparatus according to the present invention depicting the barricade apparatus in an upright, space-barricading configuration blocking the progress of an approaching vehicle shown in the background relative to the barricade apparatus.
Figure 4:
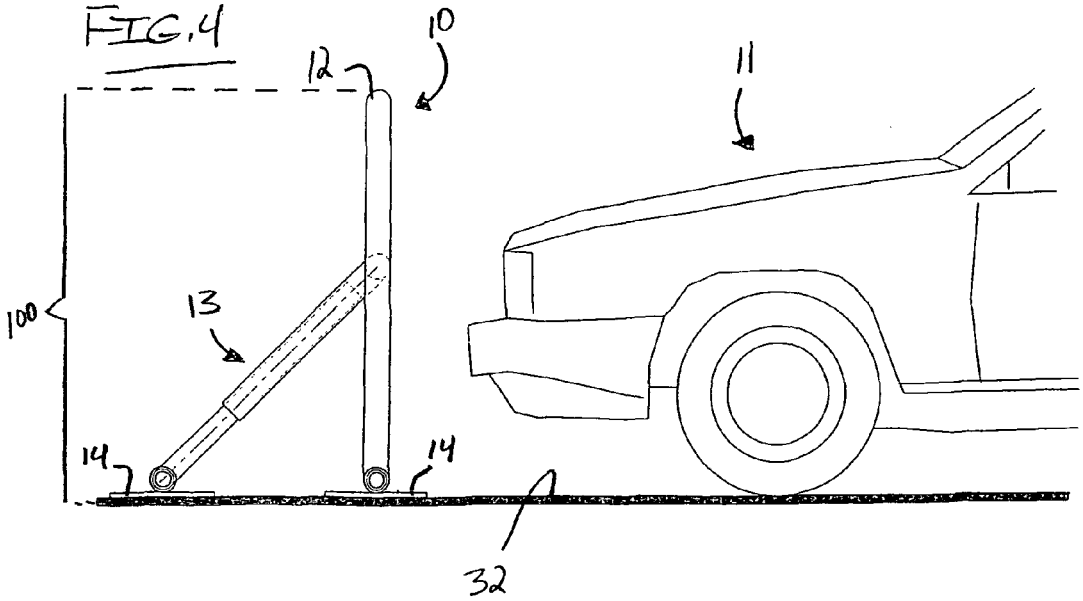
FIG. 4 is a right lateral elevational view of the collapsible barricade apparatus according to the present invention depicting the barricade apparatus in an upright, space-barricading configuration blocking the progress of an approaching fragmentary vehicle shown approaching from the right toward the front to the barricade apparatus.
Figure 5:
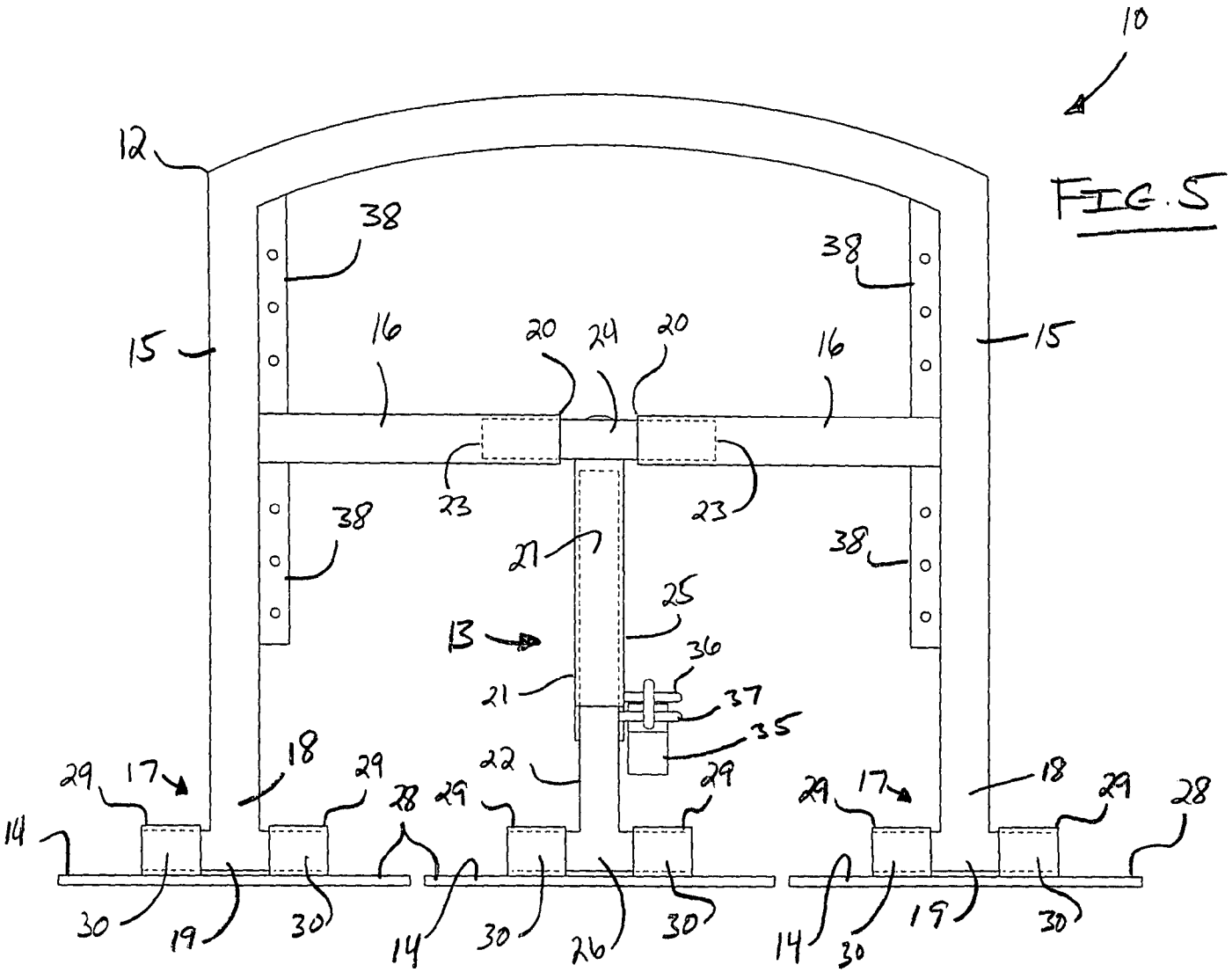
FIG. 5 is a front elevational view of the collapsible barricade apparatus according to the present invention depicting the barricade apparatus in an upright, space-barricading configuration.
Figure 5A:
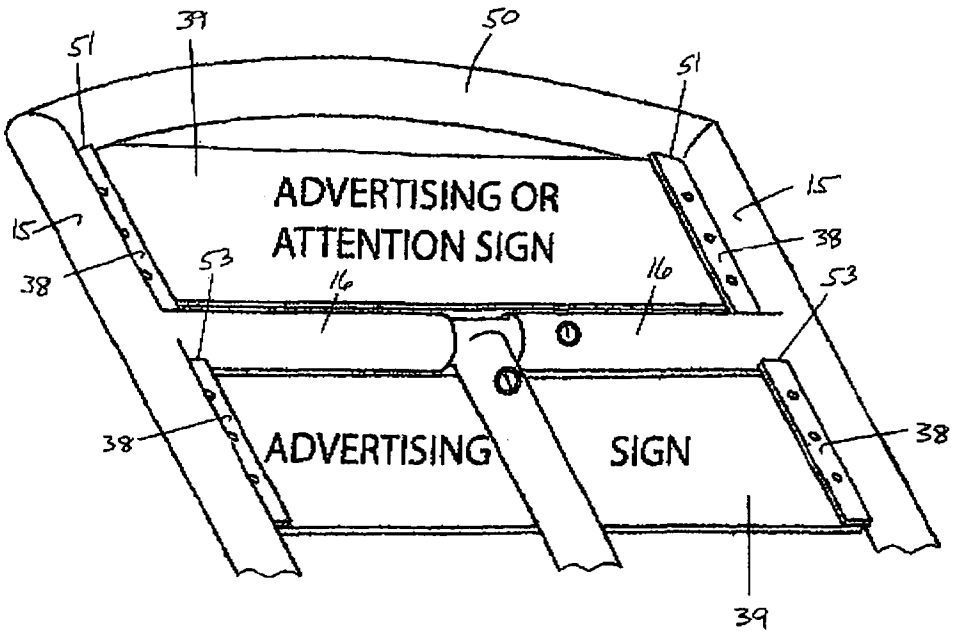
FIG. 5A is an enlarged, fragmentary sectional view of the A-frame member (outfitted with optional signage) as otherwise sectioned from FIG. 2 enlarged and fragmentary sections to more clearly show flange-to-frame junction sites.
Figure 5B:
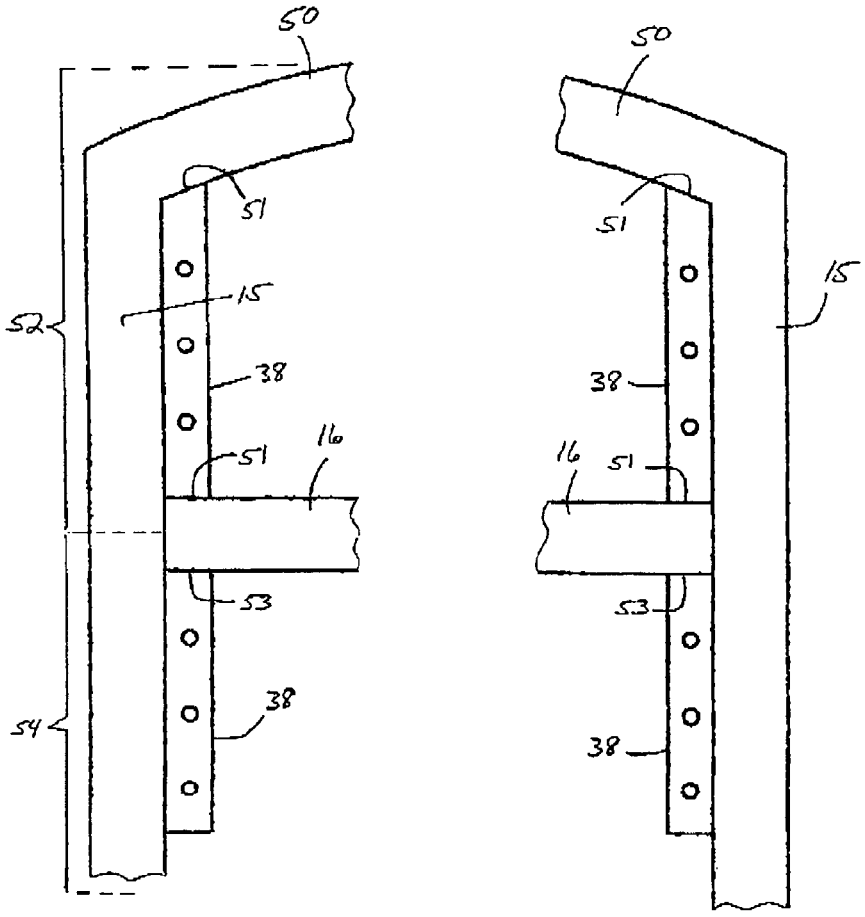
FIG. 5B is an enlarged, fragmentary sectional view of lateral portions of the A-frame member as otherwise sectioned from FIG. 5 enlarged and fragmentary sectioned to more clearly show flange-to-frame junction sites.
Figure 6:
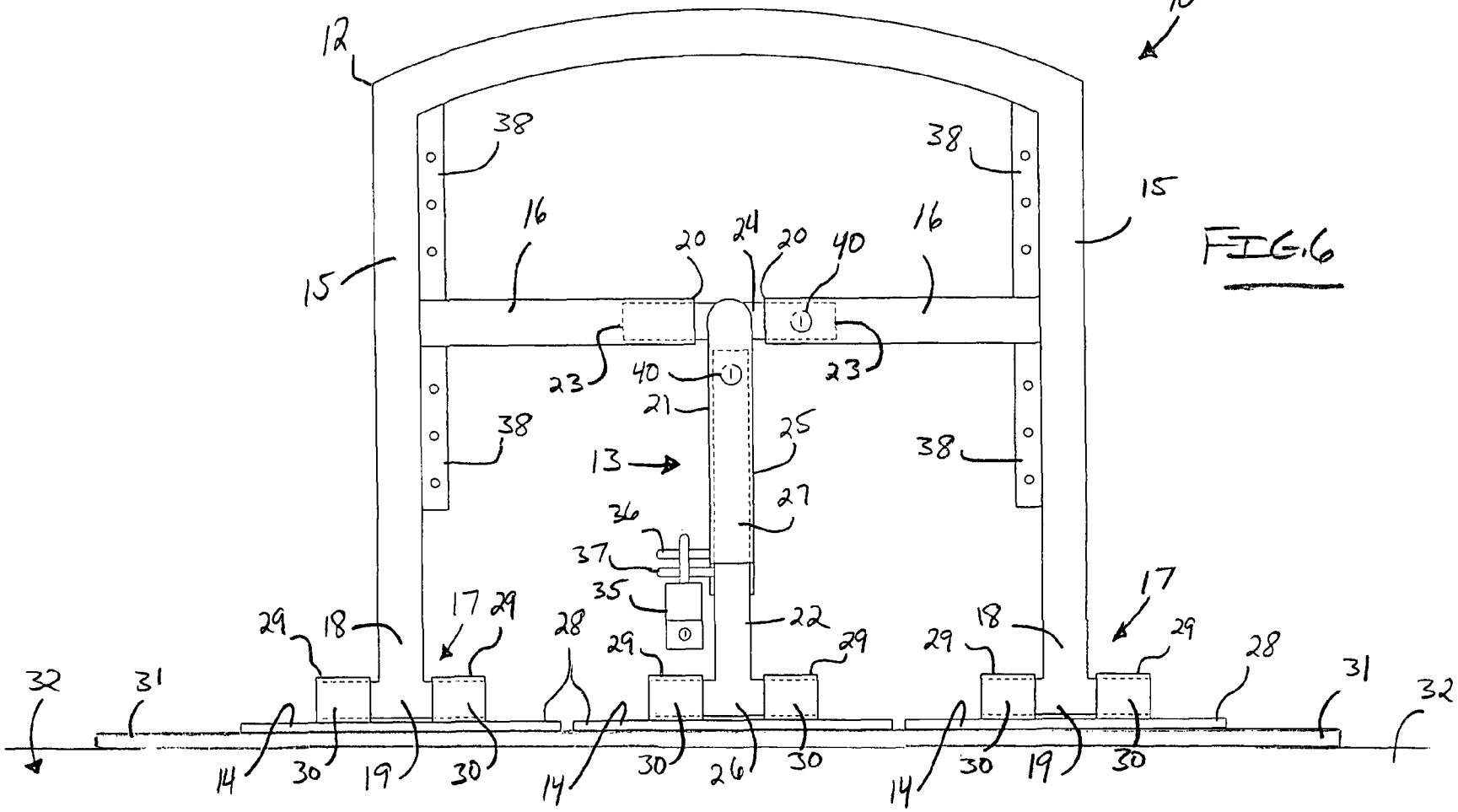
FIG. 6 is a rear elevational view of the collapsible barricade apparatus according to the present invention depicting the barricade apparatus in an upright, space-barricading configuration.

The upright member 12 comprises a height as at 100 sufficient to deter vehicles from readily passing thereover as generally and comparatively depicted in FIGS. 3 and 4. The upright member further preferably comprises a certain maximum width of a certain dimension as at 101 such that a vehicles driver side and passenger side wheels/tires may readily straddle the width 101 when in the collapsed, space-opening configuration.

The upright member comprises laterally opposed upright sections for effecting the height 100 and laterally opposed, coaxially aligned, inwardly extending upright member-crossbar portions (as at 16) for effecting certain width and adding structural integrity to the upright member. Each upright section 15 preferably comprises a footing section, which footing sections comprise a central shaft portion (as at 18) and a footing crossbar portion (as at 19) orthogonal to the central shaft portion. The upright member-crossbar portions each comprise an inward extending terminus, which termini oppose or face one another for receiving structural termini made part of the support assembly.

The telescopic support assembly is preferably formed in two sections, including an upper (T-shaped) section as at 21, and a lower (T-shaped) section as at 22. The upper section and the lower section of the support assembly each comprise a shaft-engaging end and a crossbar end. The crossbar ends are preferably orthogonal to the shaft ends, the latter of which are telescopically cooperable with one another (i.e. one shaft end is telescopically received by the other shaft end). The crossbar end of the upper section is cooperable with the inward termini for coaxially aligning and rotatably connecting the upper section to the inwardly extending upright member-crossbar portions.

The anchoring means as exemplified by a series of anchor assemblies, include a first anchor assembly and a second anchor assembly for rotatably receiving and anchoring the footing crossbar portions of the upright member to a primary support surface, and a third anchor assembly for rotatably receiving and anchoring the crossbar end of the lower section of the support assembly to the primary support surface.

Accordingly, although the invention has been described by reference to certain preferred embodiments, it is not intended that the novel barricade apparatus heretofore described be limited thereby, but that modifications thereof are intended to be included as falling within the broad scope and spirit of the foregoing disclosure, the following claims and the appended drawings.

I claim:

1. A collapsible barricade apparatus, the collapsible barricade apparatus for selectively barricading space for preventing vehicular traffic to pass through said space, the collapsible barricade apparatus comprising:

an A-shaped member, the A-shaped member comprising a top crossbar portion, laterally opposed upright sections, laterally opposed, coaxially aligned, inwardly extending, hollow, cylindrical A-crossbar portions, laterally opposed, inwardly extending upper flange structures, and laterally opposed, inwardly extending lower flange structures, the upper flange structures materially joining the laterally opposed, upright sections to both the top crossbar portion and the laterally opposed, coaxially aligned, inwardly extending hollow cylindrical A-crossbar portions thereby forming a flange-reinforced upper A section, the lower flange structures materially joining the laterally opposed upright sections to the laterally opposed, coaxially aligned, inwardly extending hollow cylindrical A-crossbar portions thereby forming a flange-reinforced lower A section, the upper and lower flange structures thus for reinforcing and maintaining the shape of the A-shaped member, each upright section comprising a T-shaped footing section, the T-shaped footing sections comprising a central shaft portion and a cylindrical T-crossbar portion orthogonal to the central shaft portion, the hollow, cylindrical A-crossbar portions each comprising an inward terminus;

an I-shaped support assembly, the support assembly comprising a T-shaped upper section and a T-shaped lower section, the T-shaped upper and lower sections each comprising a shaft end and a cylindrical T-crossbar end, the cylindrical T-crossbar ends being orthogonal to the shaft ends, the shaft ends of the upper and lower section being telescopically cooperable with one another, the cylindrical T-crossbar end of the upper section being cooperable with the inward termini and rotatively received by the hollow, cylindrical A crossbar portions for coaxially aligning and rotatably connecting the upper section to the inwardly extending, hollow, cylindrical A-crossbar portions; and first, second, and third anchor assemblies, the anchor, assemblies each comprising a planar portion and co-axial, hollow, cylindrical crossbar-engaging portions, the co-axial, hollow, cylindrical crossbar-engaging portions of the first and second anchor assemblies for rotatably receiving the cylindrical T-crossbar portions, the hollow, cylindrical crossbar-engaging portions of the third anchor assembly for rotatably receiving the cylindrical T-crossbar end of the lower section, the planar portions for interfacing the cylindrical T-crossbar portions and the cylindrical T-crossbar end with a primary planar support surface, the planar portions being fastenable to the primary planar support surface.

2. The collapsible barricade apparatus of claim 1 wherein the upper section and the lower section comprise cooperable lock-receiving means for receiving locking means when the barricade apparatus is in an upright, space-barricading configuration, the locking means for preventing the shaft ends from telescopically displacing relative to one another for collapsing the barricade apparatus to a collapsed, space-opening configuration.

3. The collapsible barricade apparatus of claim 2 wherein the lock-receiving means are defined first and second ring structures, the first ring structure being attached to the upper section and extending in a first ring plane orthogonal to the shaft end of the upper section, the second ring structure being attached to the lower section and extending in a second ring plane parallel to the first ring plane, the ring structures being coaxially aligned and adjacent to one another when the barricade apparatus is in the upright, space-barricading configuration for receiving the locking means.

4. The collapsible barricade apparatus of claim 1 wherein a select inward terminus, the shaft end of the T-shaped lower section, and the T-shaped upper section comprise cooperable locking means for (a) preventing rotation of the cylindrical T-crossbar end of the upper section relative to the hollow, cylindrical A crossbar portions, and (b) preventing telescopic displacement of the lower section relative to the upper section.

5. The collapsible barricade apparatus of claim 1 wherein the laterally opposed, inwardly extending upper and lower flange structures enable a user to attach optional signage adjacent the A-crossbar portions, the flange structures and optional signage for enhancing visibility of the barricade apparatus when in the upright, space-barricading configuration.

6. The collapsible barricade apparatus of claim 1 wherein the primary planar support surface is a sheet of structural material, the sheet of structural material enabling a user to place the primary planar support surface upon a secondary planar support surface, the collapsible barricade apparatus thereby being portable.

7. The collapsible barricade apparatus of claim 1 wherein the primary planar support surface is an upper surface of a fixed anchor material, the planar portions being fastenable to the fixed anchor material for preventing a user from dislodging the collapsible barricade apparatus.

8. A collapsible barricade apparatus, the collapsible barricade apparatus for selectively barricading space, the collapsible barricade apparatus comprising:

an upright member, the upright member comprising laterally opposed upright sections, laterally opposed, coaxially aligned, inwardly extending, hollow, cylindrical upright member-crossbar portions, and laterally opposed, inwardly extending flange structures, the flange structures materially joining the laterally opposed upright sections to the laterally opposed, coaxially aligned, inwardly extending hollow cylindrical upright member-crossbar portions thereby forming a flange-reinforced upright member, the flange structures thus for reinforcing and maintaining the shape of the upright member, each upright section comprising footing sections, the footing sections comprising a central shaft portion and a cylindrical footing crossbar portion, the hollow, cylindrical upright member-crossbar portions each comprising an inward terminus;

a support assembly, the support assembly comprising an upper section and a lower section, the upper and lower sections each comprising a shaft end and a cylindrical crossbar end, the shaft ends of the upper and lower section being telescopically cooperable with one another, the cylindrical crossbar end of the upper section being cooperable with the inward termini and rotatively received by the hollow, cylindrical upright member crossbar portions for coaxially aligning and rotatably connecting the upper section to the inwardly extending, hollow, cylindrical upright member-crossbar portions; and a series of anchor assemblies, the anchor assemblies each comprising a planar portion and co-axial, hollow, cylindrical crossbar-engaging portions, the co-axial, hollow, cylindrical crossbar-engaging portions of a first and a second anchor assembly for rotatably receiving and anchoring the cylindrical footing crossbar portions to a primary support surface, the co-axial, hollow, cylindrical crossbar-engaging portions of a third anchor assembly for rotatably receiving and anchoring the cylindrical crossbar end of the lower section to the primary support surface.

9. The collapsible barricade apparatus of claim 8 wherein the upper section and the lower section comprise cooperable lock-receiving means for receiving locking means when the barricade apparatus is in an upright, space-barricading configuration, the locking means for preventing the shaft ends from telescopically displacing relative to one another.

10. The collapsible barricade apparatus of claim 9 wherein the lock-receiving means are defined first and second ring structures, the first ring structure being attached to the upper section and extending in a first ring plane orthogonal to the shaft end of the upper section, the second ring structure being attached to the lower section and extending in a second ring plane parallel to the first ring plane, the ring structures being coaxially aligned and adjacent to one another when the barricade apparatus is in an upright, space-barricading configuration.

11. The collapsible barricade apparatus of claim 8 wherein a select inward terminus, the shaft end of the lower section, and the upper section comprise cooperable locking means for (a) preventing rotation of the cylindrical crossbar end of the upper section relative to the hollow, cylindrical upright member-crossbar portions, and (b) preventing telescopic displacement of the lower section relative to the upper section.

12. The collapsible barricade apparatus of claim 8 wherein the laterally opposed, inwardly extending flange structures enable a user to attach optional signage adjacent the upright member-crossbar portions, the flange structures and optional signage for enhancing visibility of the barricade apparatus when in the upright, space-barricading configuration.

13. The collapsible barricade apparatus of claim 8 comprising the primary support surface, the primary support surface being a sheet of structural material, the sheet of structural material enabling a user to place the primary support surface upon a secondary support surface, the collapsible barricade apparatus thereby being portable.

14. The collapsible barricade apparatus of claim 8 wherein the primary support surface is an upper surface of a fixed anchor material, the anchor assemblies being fastenable to the fixed anchor material for preventing a user from dislodging the collapsible barricade apparatus.

15. A collapsible barricade apparatus, the collapsible barricade apparatus for selectively barricading space, the collapsible barricade apparatus comprising:

an upright member, the upright member having a member length, a member width, laterally opposed upright sections, coaxially aligned, inwardly extending, hollow, cylindrical upright member-crossbar portions, footing sections, and laterally opposed, inwardly extending flange structures, the flange structures materially joining the laterally opposed upright sections to the laterally opposed, coaxially aligned, inwardly extending hollow cylindrical upright member-crossbar portions thereby forming a flange-reinforced upright member, the flange structures thus for reinforcing and maintaining the shape of the upright member, the footing sections comprising a cylindrical footing crossbar portion, the hollow, cylindrical upright member-crossbar portions each comprising an inward terminus;

a telescopic support assembly, the support assembly comprising an upper section and a lower section telescopic relative to one another, the upper and lower sections each comprising a cylindrical crossbar end, the cylindrical crossbar end of the upper section being cooperable with the inward termini and rotatively received by the hollow, cylindrical upright member crossbar portions for coaxially aligning and rotatably connecting the upper section to the inwardly extending, hollow, cylindrical upright member-crossbar portions; and anchoring means, the anchoring means comprising a planar portion and hollow, cylindrical crossbar-engaging portions, the hollow, cylindrical crossbar-engaging portions of the anchoring means for rotatably receiving and anchoring the cylindrical footing crossbar portions and the cylindrical crossbar end of the lower section to a primary support surface.

16. The collapsible barricade apparatus of claim 15 wherein the upper section and the lower section comprise cooperable lock-receiving means for receiving locking means when the barricade apparatus is in an upright, space-barricading configuration.

17. The collapsible barricade apparatus of claim 15 wherein the telescopic support assembly extends in a plane angled 45 rotational degrees relative to the upright member when the barricade apparatus is in an upright, space-barricading configuration.

18. The collapsible barricade apparatus of claim 17 wherein the telescopic support assembly is substantially coplanar with the upright member when the barricade apparatus is in a collapsed, space-opening configuration.

19. The collapsible barricade apparatus of claim 15 comprising the primary support surface, the primary support surface being a sheet of structural material, the sheet of structural material enabling a user to position the primary support surface upon a secondary support surface, the collapsible barricade apparatus thereby being portable.

20. The collapsible barricade apparatus of claim 15 wherein the primary support surface is an upper surface of a fixed anchor material, the anchoring means being fastenable to the fixed anchor material for preventing a user from dislodging the barricade apparatus as fastened.

* * * * *